US006119663A

United States Patent [19]

Okuma

[11] Patent Number: 6,119,663

[45] Date of Patent: Sep. 19, 2000

[54] METHOD AND APPARATUS FOR DIAGNOSING LEAKAGE OF FUEL VAPOR TREATMENT UNIT

[75] Inventor: Shigeo Okuma, Atsugi, Japan

[73] Assignee: Unisia Jecs Corporation, Atsugi, Japan

[21] Appl. No.: 09/267,666

[22] Filed: Mar. 15, 1999

[30] Foreign Application Priority Data

| | | | |
|---|---|---|---|
| Mar. 31, 1998 | [JP] | Japan | 10-085867 |
| May 15, 1998 | [JP] | Japan | 10-133515 |
| Nov. 19, 1998 | [JP] | Japan | 10-329294 |

[51] Int. Cl.[7] ..... F02M 33/02

[52] U.S. Cl. ..... 123/520; 123/198 D

[58] Field of Search ..... 123/520, 519, 123/518, 516, 521, 198 D

[56] References Cited

U.S. PATENT DOCUMENTS

| | | | |
|---|---|---|---|
| 5,349,935 | 9/1994 | Mezger | 123/198 D |
| 5,390,645 | 2/1995 | Cook | 123/198 D |
| 5,460,141 | 10/1995 | Denz | 123/198 D |
| 5,499,614 | 3/1996 | Busato | 123/198 D |
| 5,553,577 | 9/1996 | Denz | 123/520 |
| 5,845,625 | 12/1998 | Kidokoro | 123/520 |
| 5,881,700 | 3/1999 | Gras | 123/520 |
| 5,967,124 | 10/1999 | Cook | 123/198 D |

FOREIGN PATENT DOCUMENTS 5-215020 8/1993 Japan .

*Primary Examiner*—Carl S. Miller
*Attorney, Agent, or Firm*—Foley & Lardner

[57] ABSTRACT

With a fuel vapor treatment unit where fuel vapor of an internal combustion engine which has been temporarily adsorbed into an adsorption device is drawn into an engine intake system under predetermined engine operating conditions, a judgment level is set based on a drive current of an electric pump for when air is pumped by the electric pump via a reference orifice having a reference aperture diameter, and the presence of fuel vapor leakage is diagnosed by comparing a drive current of the electric pump for when air is pumped by the electric pump bypassing the reference orifice and into piping to be leak diagnosed of the fuel vapor treatment unit, with the set judgment level. Moreover, the drive current of the electric pump for when air is pumped via the reference orifice is compared with a reference level, and when the drive current deviates from the reference level, the leakage diagnosis is stopped. Furthermore, refuelling judgment is performed, and the leakage diagnosis is started after judging that refuelling is completed. In this way, erroneous diagnosis due to blockage or contamination of the reference orifice, or erroneous diagnosis due to diagnosis being made during refuelling can be prevented, enabling an improvement in leakage diagnosis accuracy.

8 Claims, 11 Drawing Sheets

METHOD AND APPARATUS FOR DIAGNOSING LEAKAGE OF FUEL VAPOR TREATMENT UNIT

BACKGROUND OF THE INVENTION

1. Field of the Invention

The present invention relates to a method and apparatus for diagnosing leakage of a fuel vapor treatment unit of an internal combustion engine, and in particular to technology for preventing erroneous diagnosis.

2. Description of the Related Art

With conventional fuel vapor treatment units for internal combustion engines, evaporation of fuel vapor into the atmosphere is prevented by temporarily adsorbing fuel vapor produced in the fuel tank etc. into a canister, and then, under predetermined engine operating conditions, de-adsorbing the adsorbed fuel vapor and mixing this with purge air, and drawing the purge mixture into the engine intake system, while controlling the flow with a purge control valve (refer to Japanese Unexamined Patent Publication No. 5-215020).

With the above units however, if a crack occurs along the fuel vapor piping, or a fault occurs in a seal at a fuel vapor piping connection, then the fuel vapor will evaporate into the atmosphere from the leak portion, so that the original evaporation prevention effect cannot be fully realized.

For an apparatus for diagnosing the presence of such fuel vapor leaks, the following methods have been contemplated.

That is to say, there is an apparatus which diagnosis the presence of fuel vapor leaks by setting a judgment level based on a drive current of an electric pump for when air is pumped by the electric pump via a reference orifice having a reference aperture diameter, and then comparing a drive current of the electric pump for when air is pumped by the electric pump bypassing the reference orifice and into piping to be leak diagnosed of the fuel vapor treatment unit, with the set judgment level. More specifically, when the drive current is less than the judgment level, it is diagnosed that a fuel vapor leak has occurred. That is to say, when a leakage amount is produced which is larger than the leakage amount for when a hole equivalent to the reference orifice occurs, then due to the reduction in air pumping load the drive current of the electric pump falls below the judgment level. Hence the presence of leaks can be diagnosed by comparison with the judgment level.

With the above method, it is possible to diagnose to a high accuracy, even when a small leakage amount is produced such as in the case where a very small hole occurs in the piping.

However, with the above method, if due to the occurrence of blockage or contamination in the reference orifice, the drive current of the electric pump for when air is pumped through the reference orifice increases markedly and the presence of leaks is diagnosed using a judgement level set based on this drive current, there is the possibility of an erroneous diagnosis of the presence of a leak in the case where there is actually no leak.

Furthermore, with the method for performing leakage diagnosis as described above after stopping operation of the engine, if leakage diagnosis is executed at the time of opening the filler cap of the fuel tank for refuelling, since the interior of the fuel vapor supply system is opened to the atmosphere, then the drive current of the electric pump will be reduced so that there will be an erroneous diagnosis that a leak has occurred. This erroneous diagnosis situation is not limited to pressurising methods using an electric pump. For example a similar erroneous diagnosis can also occur with a method where pressure stored inside an accumulator during engine operation is supplied to inside the fuel vapor supply system, and diagnosis is made based on a subsequent pressure change.

SUMMARY OF THE INVENTION

The present invention takes into consideration such heretofore problems, with the object of providing a method and apparatus for diagnosing leakage of a fuel vapor treatment unit, which prevents erroneous leakage diagnosis caused by blockage or contamination etc. of the reference orifice.

Furthermore, it is an object be able to accurately execute the prevention of erroneous leakage diagnosis caused by blockage or contamination etc., while avoiding other influences due to various fluctuations or a drop in air density.

Moreover, it is an object to provide a method and apparatus for diagnosing leakage of a fuel vapor treatment unit, wherein with an apparatus wherein fuel vapor leakage diagnosis is performed after stopping engine operation, then even if refuelling is being performed, accurate leakage diagnosis can be executed for each resumption of travel.

Therefore, with the method of diagnosing leakage of a fuel vapor treatment unit according to a first aspect of the invention, with a fuel vapor treatment unit which temporarily adsorbs fuel vapor from a fuel tank of an internal combustion engine into an adsorption device and then draws this into an engine intake system under predetermined engine operating conditions, the method comprises the steps of;

setting a judgment level based on a drive current of an electric pump for when air is pumped by the electric pump via a reference orifice having a reference aperture diameter, and diagnosing the presence of fuel vapor leakage by comparing a drive current of the electric pump for when air is pumped by the electric pump bypassing the reference orifice and into piping to be leak diagnosed of the fuel vapor treatment unit, with the set judgment level, and further comprises;

comparing the drive current of the electric pump for when air is pumped via the reference orifice, with a reference level, and when the drive current deviates from the reference level, stopping the leakage diagnosis.

The leakage diagnosis apparatus for a fuel vapor treatment unit according to a first aspect of the invention, comprises a fuel vapor treatment unit which temporarily adsorbs fuel vapor from a fuel tank of an internal combustion engine into an adsorption device and then draws this into an engine intake system under predetermined engine operating conditions, and also comprises;

a judgment level setting device for setting a judgment level based on a drive current of an electric pump for when air is pumped by the electric pump via a reference orifice having a reference aperture diameter, and a leakage diagnosis device for diagnosing the presence of fuel vapor leakage by comparing a drive current of the electric pump for when air is pumped by the electric pump bypassing the reference orifice and into piping to be leak diagnosed of the fuel vapor treatment unit, with the set judgment level, and further comprises;

a leakage diagnosis stopping device for comparing the drive current of the electric pump for when air is pumped via the reference orifice, with a reference level, and when the drive current deviates from the reference level, stopping diagnosis by the leakage diagnosis device.

According to the method and apparatus for diagnosing leakage of a fuel vapor treatment unit according to the first aspect of the invention, at the time of leakage diagnosis, the drive current of the electric pump for when air is pumped by the electric pump via the reference orifice having the reference aperture diameter is measured, and the measured drive current is compared with the reference level, and when this deviates from the reference level, the leakage diagnosis is stopped.

When the measured drive current does not deviate from the reference level, the judgment level setting device sets the judgment level for leakage diagnosis based on the drive current.

Then, the drive current of the electric pump for when air is pumped by the electric pump bypassing the reference orifice and into piping to be leak diagnosed of the fuel vapor treatment unit, is compared with the set judgment level, to thereby diagnose the presence of fuel vapor leaks.

In this way, in the case where, as a result of a blockage or contamination etc. of the reference orifice, the drive current while pumping air through the reference orifice deviates from the reference level, then the leakage diagnosis is stopped. Therefore erroneous diagnosis using a judgment level set based on a drive current which deviates from the reference level can be prevented.

Here, the reference level may be set based on various fluctuations.

If this is done, then by setting as the reference level an error range for the maximum limit produced due to various fluctuations such as deviations in the aperture diameter of the reference orifice, fluctuations in flow characteristics of the electric pump, or fluctuations in the current measurement value, then only erroneous diagnosis attributable to blockages or contamination etc. of the orifice, and not that due to these fluctuations, can be prevented.

Furthermore, the reference level may be correctingly set corresponding to air density.

In this way, since in the case for example where the air density drops while travelling at higher altitudes, the drive current of the electric pump changes, then by correctingly setting the reference level corresponding to the air density,it is possible to correctly judge whether or not to stop leakage diagnosis without being influenced by air density.

Moreover, the fuel vapor treatment unit may incorporate a switching valve for switching between a passage which passes air from the electric pump via the reference orifice, and a passage bypassing the reference orifice, which passes air via piping to be leak diagnosed, and the leakage diagnosis may also be stopped when the drive current of the electric pump immediately after switching the switching valve from the passage via the reference orifice to the passage bypassing the reference orifice, deviates from a judgment level set corresponding to immediately after the switching (second leakage diagnosis stopping device).

If this is done, then when leakage diagnosis is performed by the leakage diagnosis device, if the switching valve is operated so as to switch from the passage which passes air from the electric pump via the reference orifice, to the passage bypassing the reference orifice, which passes air via the piping to be leak diagnosed, in the case where the switching is effected normally, then due to the volume of the piping the load on the electric pump immediately after switching drops significantly and the drive current drops suddenly accordingly.

Therefore, the judgment level for the drive current of the electric pump is set corresponding to the conditions immediately after the switching operation of the switching valve. In the case where the drive current of the electric pump immediately after the switching operation deviates from the judgment level corresponding to immediately after the switching, it is diagnosed that the switching valve is not switching normally, and hence leakage diagnosis is stopped. The leakage diagnosis is thus only executed when the drive current does not deviate from the judgment level.

In this way, the leakage diagnosis accuracy is further improved.

Moreover, with the method of diagnosing leakage of a fuel vapor treatment unit according to a second aspect of the invention, with a fuel vapor treatment unit which temporarily adsorbs fuel vapor from a fuel tank of an internal combustion engine into an adsorption device and then draws this into an engine intake system under predetermined engine operating conditions, the method comprises the step of;

diagnosing the presence of fuel vapor leakage after engine operation has stopped, and further comprises the step of;

detecting whether or not the fuel tank is being refuelled after engine operation has stopped, and starting the diagnosis for the presence of fuel vapor leakage after completion of the refuelling.

Furthermore, the leakage diagnosis apparatus for a fuel vapor treatment unit according to the second aspect of the invention, comprises a leakage diagnosis device for diagnosing the presence of fuel vapor leakage after stopping engine operation, in a fuel vapor treatment unit which temporarily adsorbs fuel vapor from a fuel tank of an internal combustion engine into an adsorption device and then draws this into an engine intake system under predetermined engine operating conditions, and further comprises; a refuelling detection device for detecting whether or not the fuel tank is being refuelled after engine operation has stopped, and a diagnosis delay device for starting the diagnosis for the presence of fuel vapor leakage after completion of refuelling.

According to the method and apparatus for diagnosing leakage of a fuel vapor treatment unit according to the second aspect of the invention, after engine operation has stopped it is detected whether or not the fuel tank is being refuelled, and based on the detection results, on completion of refuelling, fuel vapor leakage diagnosis is started. In this way, erroneous diagnosis due to performing leakage diagnosis during refuelling can be prevented.

Here, the diagnosis can be started when detected that refuelling has been completed.

In this way, refuelling detection continues until completion of refuelling, and when detected that refuelling has been completed, the fuel vapor leakage diagnosis is started.

Moreover, the diagnosis can be started after lapse of a predetermined time from once detecting that refuelling is being performed.

In this way, when once detected that refuelling is being performed, leakage diagnosis is started after waiting for the lapse of a predetermined time thereafter sufficient for completion of refuelling.

Furthermore, the leakage diagnosis may include diagnosing the presence of leaks by pressurizing the interior of a fuel vapor supply system from the fuel tank to the engine intake system with the fuel vapor supply system tightly closed, and detecting parameters which change due to the presence of leaks when pressurizing the interior of the fuel vapor supply system.

If this is done, then when the interior of the fuel vapor supply system is pressurized, with the fuel vapor supply system from the fuel tank to the engine intake system tightly closed, since due to the presence of leaks for example the pressurizing loading or the pressure conditions after pressurizing change, then the presence of leaks can be diagnosed based on these parameters.

Moreover, the presence of leaks may be diagnosed based on a drive current for when the interior of the fuel vapor supply system is pressurized by the electric pump.

If this is done, then since the drive current for when the interior of the fuel vapor supply system is pressurized by the electric pump drops when leakage occurs, the presence of leaks can be diagnosed by means of the drive current.

Furthermore, refuelling may be detected based on the drive current for when the interior of the fuel vapor supply system is pressurized by the electric pump.

In this way, since when the drive current for when the interior of the fuel vapor supply system is pressurised by the electric pump during refuelling is reduced significantly compared to when refuelling is not being performed, then whether or not refuelling is being performed can be detected based on the drive current.

DESCRIPTION OF THE PREFERRED EMBODIMENTS

As follows is a description of embodiments of the present invention.

Figure 1:
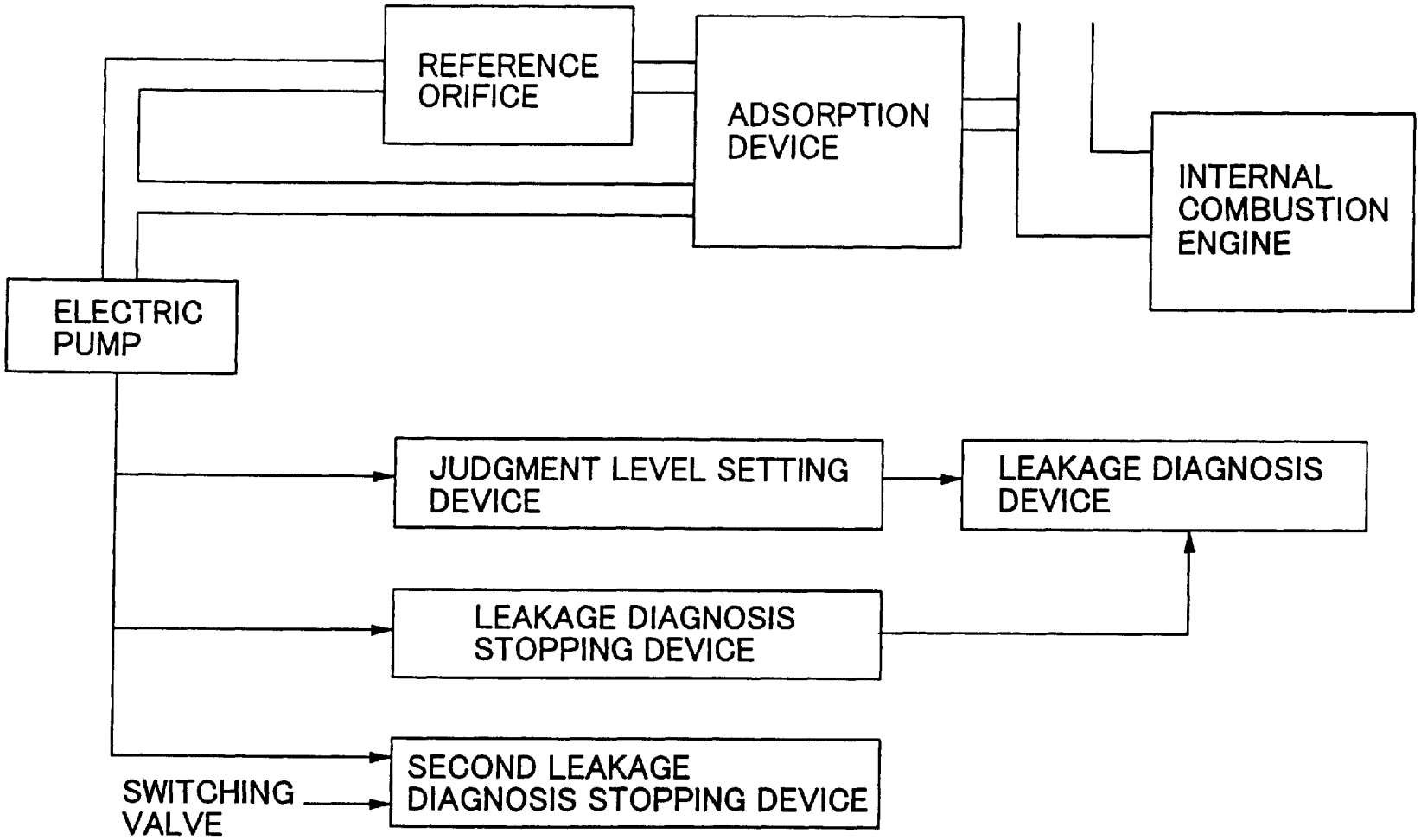
FIG. 1 is a block diagram showing the construction and operation of an embodiment according to a first aspect of the invention.

In FIG. 1 showing the construction and operation of an embodiment according to a first aspect of the invention, an adsorption device temporarily adsorbs fuel vapor from a fuel tank of an internal combustion engine, and the adsorbed fuel vapor is then drawn into an engine intake system under predetermined engine operating conditions.

A judgment level setting device sets a judgment level based on a drive current of an electric pump for when air is pumped by the electric pump via a reference orifice having a reference aperture diameter.

A leakage diagnosis device compares a drive current of the electric pump for when air is pumped by the electric pump bypassing the reference orifice and into piping to be leak diagnosed of a fuel vapor treatment unit, with the set judgment level to thereby diagnose the presence of fuel vapor leaks.

A leakage diagnosis stopping device compares the drive current of the electric pump for when air is pumped via the reference orifice, with a reference level, and when this deviates from the reference level, stops leakage diagnosis by the leakage diagnosis device.

A second leakage diagnosis stopping device stops the leakage diagnosis when the drive current of the electric pump immediately after a switching valve for switching between a passage which passes air from the electric pump via the reference orifice, and a passage bypassing the reference orifice, which passes air via piping to be leak diagnosed, is switched from the passage via the reference orifice to the passage bypassing the reference orifice, deviates from a judgment level set corresponding to immediately after switching.

Figure 2:
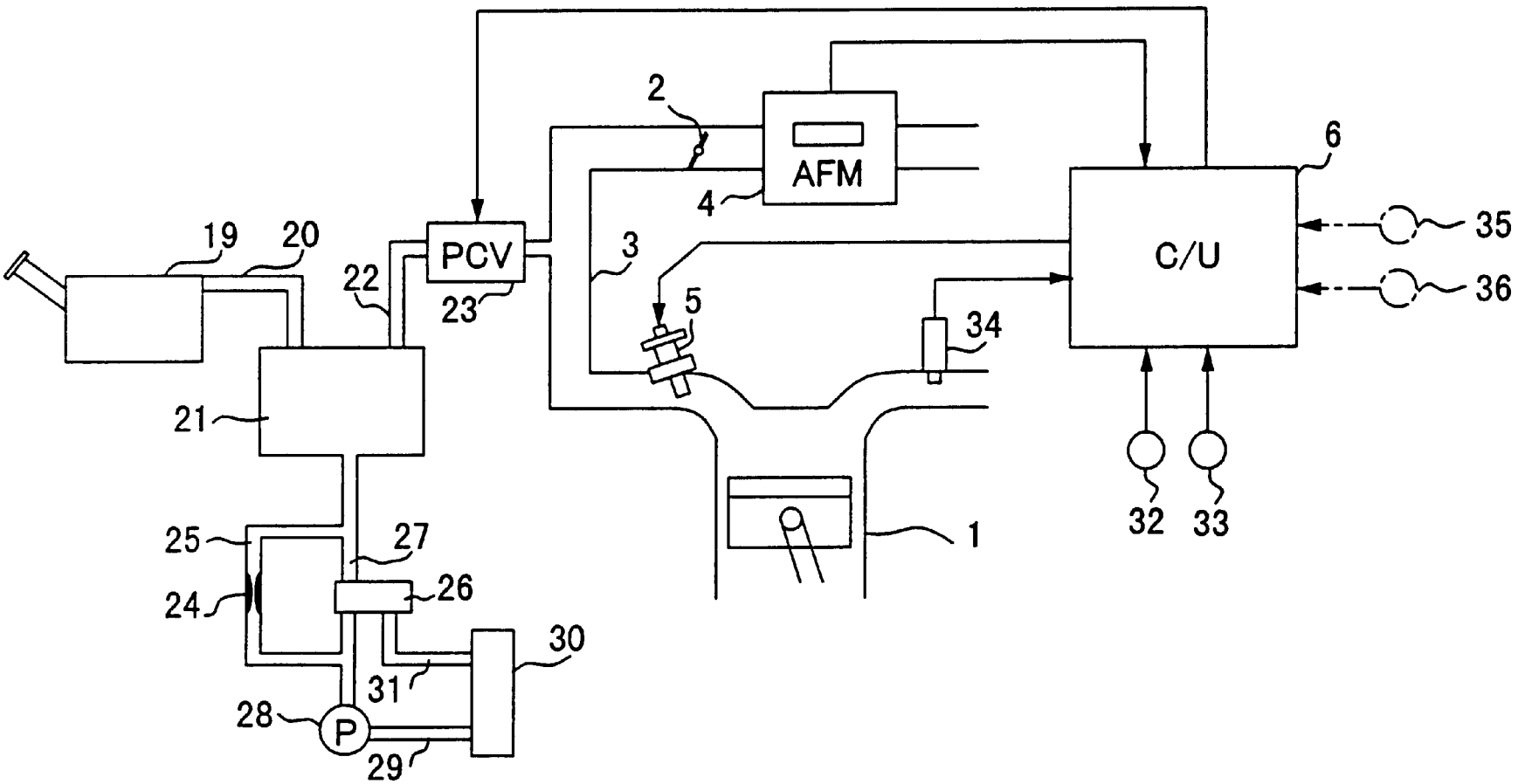
FIG. 2 is a diagram showing a system diagram common to embodiments according to the first aspect of the invention and a second aspect of the invention.

In FIG. 2, showing the system structure of an embodiment according to the first aspect of the invention, air is drawn into an internal combustion engine 1 via an intake passage 3 in which is disposed a throttle valve 2 linked to an accelerator pedal (not shown in the figure).

An air flow meter 4 for detecting an intake air quantity which is flow controlled by the throttle valve 2, is disposed in an upstream section of the intake passage 3, and solenoid type fuel injection valves 5 are provided for each cylinder, in a downstream section (manifold section) of the intake passage 3, for injecting fuel pumped from a fuel pump (not shown in the figure) and controlled to a predetermined pressure by a pressure regulator, into the intake passage 3. Control of a fuel injection quantity from the fuel injection valve 5 is performed by a control unit 6 incorporating a microcomputer.

Furthermore, the engine 1 is provided with a fuel vapor treatment unit. The fuel vapor treatment unit adsorbs and collects fuel vapor produced in a fuel tank 19, in an adsorption material such as activated carbon filled into a canister 21 serving as an adsorption device, by way of a fuel vapor introduction passage 20. The fuel adsorbed in the adsorption material is then supplied to the intake passage 3 on the downstream side of the throttle valve 2 via a purge passage 22.

In the purge passage 22 is disposed a solenoid operated purge control valve 23 which is controlled based on a control signal from the control unit 6.

For diagnosing leakage of fuel vapor in the fuel vapor treatment unit, the following piping system is constructed. That is to say, an electric pump 28 is connected to an air introduction port opened at a lower portion of the canister 21, by means of a first passage 25 in which is disposed a reference orifice 24 having a reference aperture diameter of for example 0.5 mm, and a second passage 27 connected in parallel with the first passage 25 by way of one port of a switching valve 26. An air introduction passage 29 connected to an intake port of the electric pump 28 introduces air via an air filter 30. An air discharge passage 31 is connected to the other port of the switching valve 26. With the switching valve 26 in one condition (shown in FIGS. 4 and 5), the other port is communicated with the second passage 27 which leads to the air introduction port of the canister 21 so that air is discharged from the air discharge passage 31 and into the atmosphere via the air filter 30. Furthermore, when the switching valve 26 is switched from the one condition (shown in FIGS. 4 and 5) and moved to the right side (FIG. 6), the second passage 27 is opened via the one port so that the electric pump 28 is communicated with the air introduction port of the canister 21 via the second passage 27.

Moreover, there is provided a rotational speed sensor 32 for detecting an engine rotational speed N, a water temperature sensor 33 for detecting water temperature Tw, and an air-fuel ratio sensor 34 for detecting air-fuel ratio based for example on oxygen concentration in the exhaust. Detection signals from these sensors are output to the control unit 6.

The control unit 6 controls the fuel injection amount from the fuel injection valves 5, based on signals from the respective sensors to thereby effect air-fuel ratio feedback control, and under predetermined operating conditions, controls the purge control valve 23 to effect processing for purging the fuel vapor into the intake system, and under predetermined conditions effects fuel vapor leakage diagnosis according to the present invention.

Figure 3:
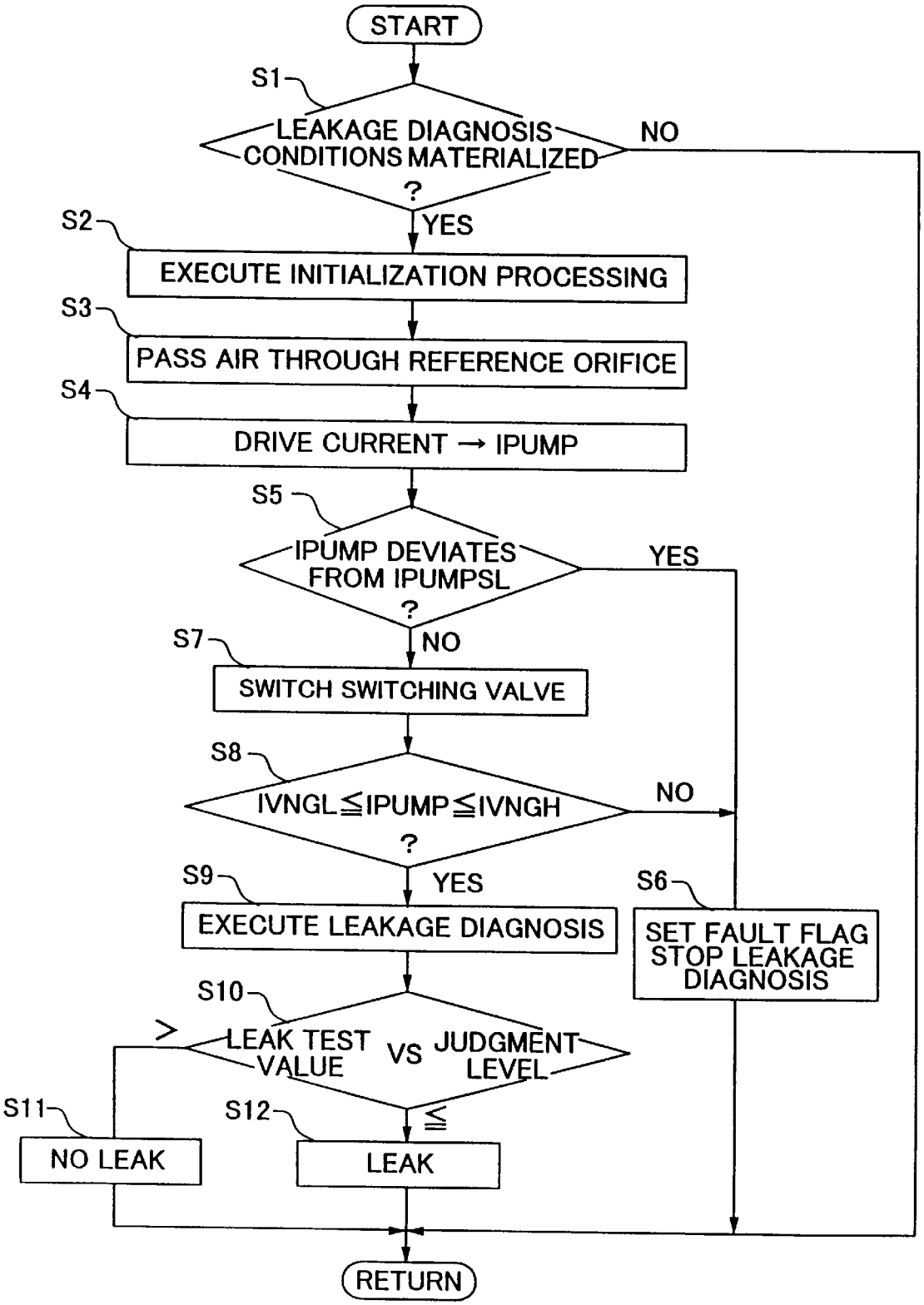
FIG. 3 is a flow chart showing a leakage diagnosis routine of a first embodiment according to the first aspect of the invention.

A fuel vapor leakage diagnosis routine carried out by the control unit 6 for such a construction will be explained in accordance with the flow chart of FIG. 3.

In step 1 (abbreviated to S1 in the figures with other steps similarly abbreviated), it is judged if predetermined leakage diagnosis start conditions, for example the following conditions, have been met.

Engine rotational speed and vehicle speed are each below predetermined values, or the engine is stopped.

It is diagnosed in a separately executed fault diagnosis routine for the purge control valve 23 that there are no faults.

When judged in step 1 that the leakage diagnosis conditions have materialized, control proceeds to step 2 to execute processing for initializing the fuel vapor purge system environment. More specifically, the purge control valve 23 is opened, the one port of the switching valve 26 is closed, the other port is opened, and the electric pump 28 is driven, and this condition is maintained for a predetermined time.

Figure 4:
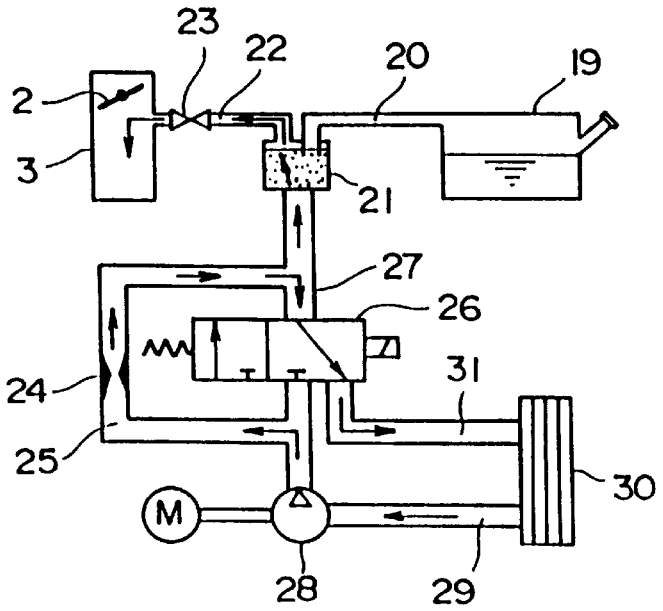
FIG. 4 is a diagram showing the flow of air at the time of executing initialization processing in the first embodiment.

At this time, as shown in FIG. 4, due to operation of the electric pump 28, air introduced via the air filter 30 and the air introduction passage 29 passes via the first passage 25 through the canister 21 and is discharged into the intake passage 3 via the purge passage 22. Furthermore, a part of the air passes from the switching valve 26 via the air discharge passage 31 and the air filter 30 and is discharged into the atmosphere.

As a result, the residual pressure (negative pressure) and residual gas inside the purge passage 22 is eliminated.

Then, prior to executing leakage diagnosis, the leakage diagnosis system performs self diagnosis. At first, in step 3, the purge control valve 23 is closed, the one port of the switching valve 26 is closed, the other port is opened, and the electric pump 28 is driven, and this condition is maintained for a predetermined time.

Figure 5:
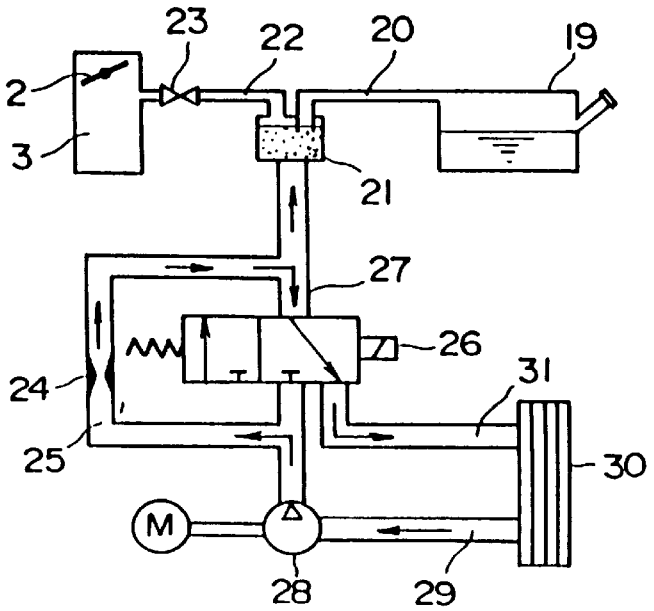
FIG. 5 is a diagram showing the flow of air at the time of setting a judgment level in the first embodiment.

At this time, as shown in FIG. 5, due to operation of the electric pump 28, air introduced via the air filter 30 and the air introduction passage 29, passes via the first passage 25 and is discharged to the atmosphere from the switching valve 26 via the air discharge passage 31 and the air filter 30.

After lapse of a predetermined time under this condition, control proceeds to step 4 where the drive current of the electric pump 28 is detected and stored as IPUMP. That is to say, the drive current of the electric pump 28 for when the air passes through the reference orifice 24 having the reference aperture diameter is detected.

In step 5, the drive current IPUMP is compared with a reference level IPUMPSL to judge if the drive current IPUMP deviates from the reference level IPUMPSL. Here for the reference level IPUMPSL a value calculated as follows is used:

$$\text{Deviation } \Delta I \text{ due to various fluctuations} = [(\text{orifice deviations})^2 + (\text{electric pump current fluctuations})^2 + (\text{current measurement fluctuations})^2]^{1/2}.$$

Then making the drive current of the electric pump for when air is pumped through the reference orifice, in the case where the various fluctuations are zero, a reference value IBASE, gives the following settings:

$$\text{Reference level lower limit value } (-\text{IPUMPSL}) = \text{reference value IBASE} - \Delta I$$

$$\text{Reference level upper limit value } (+\text{IPUMPSL}) = \text{reference value IBASE} + \Delta I$$

Furthermore, with the judgment of step 5, when judged that the measured drive current IPUMP deviates from $-\text{IPUMPSL} \leqq \text{IPUMP} \leqq +\text{IPUMPSL}$, it is judged that the leakage diagnosis system is faulty. Hence control proceeds to step 6 where a fault judgment flag is set, the leakage diagnosis is stopped, and the routine then terminated. That is to say, the function of step 5 corresponds to the leakage diagnosis stopping device.

On the other hand, with the judgment of step 5, when judged that the measured drive current IPUMP is within the reference level IPUMPSL, control proceeds to step 7 in order to perform leakage diagnosis, wherein, with the electric pump 28 operating, the purge control valve 23 is closed, and switching is effected to close the other port of the switching valve 26 and open the one port.

Figure 6:
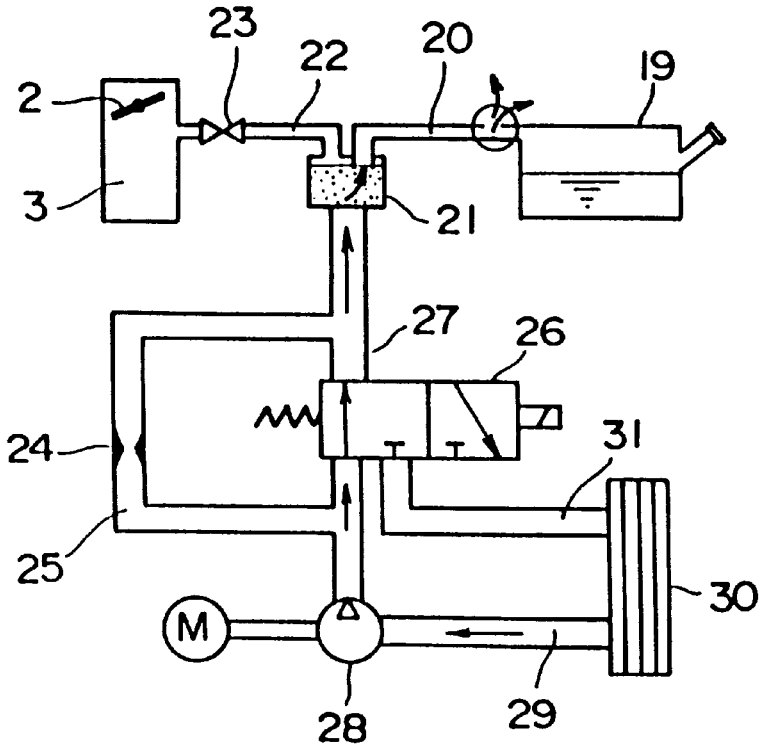
FIG. 6 is a diagram showing the flow of air at the time of executing leakage diagnosis testing in the first embodiment.

At this time, as shown in FIG. 6 the passages are switched so that air introduced via the air filter 30 and the air introduction passage 29 due to operation of the electric pump 28, passes via the second passage 27 through the canister 21 and flows into the fuel vapor introduction passage 20 and the purge passage 22, reaching from the fuel tank 19 to the purge control valve 23.

Figure 7:
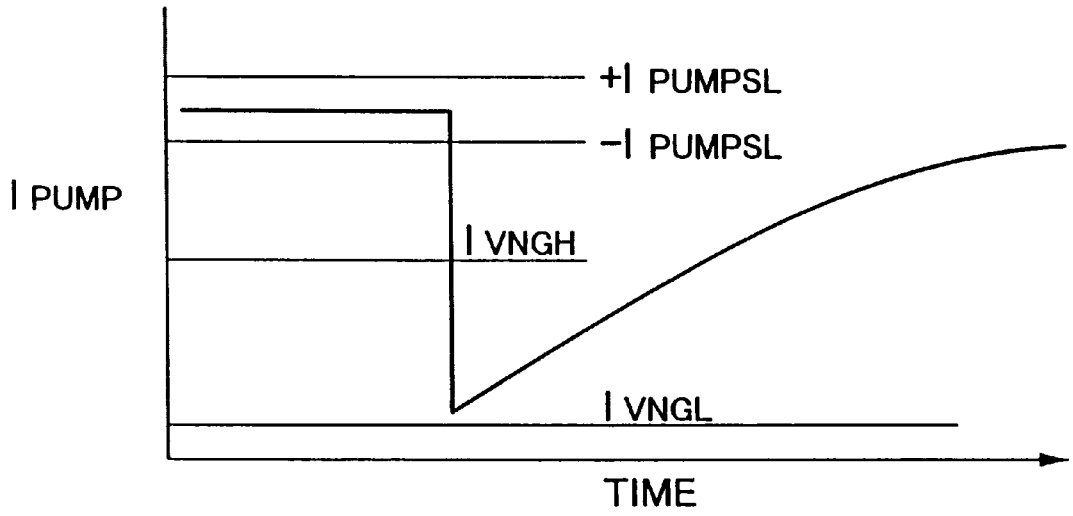
FIG. 7 is a diagram showing a situation immediately after switching operation of a switching valve in the first embodiment.

In step 8, the drive current IPUMP immediately after switching of the switching valve 26 is measured, and judgment is made as to whether or not the drive current IPUMP measured immediately after switching satisfies the judgment level set corresponding to the condition immediately after switching. Here, immediately after switching the switching valve 26 as described above from the passage via the reference orifice 24 to the passage bypassing the reference orifice 24 and into the piping to be leak diagnosed, there is a delay while the piping is filled by air pumped from the electric pump 28. The load on the electric pump 28 thus drops significantly, and accompanying this the drive current also drops significantly. Therefore, an upper limit value IVNGH and a lower limit value IVNGL are set as judgment levels corresponding to the condition of the drive current immediately after switching ($\text{IVNGL} < \text{IVNGH} < -\text{IPUMPSL} < +\text{IPUMPSL}$), and it is judged whether or not the drive current IPUMP satisfies IVNGL≦IPUMP≦IVNGH (refer to FIG. 7). Here, also at the time of setting the upper limit value IVNGH and the lower limit value IVNGL, setting is performed as mentioned before taking into consideration the influence of the product variations, and the influence of air density, to be described later. Furthermore, in order to distinguish from a diagnosis for disconnection, IVNGL is set to greater than zero.

When judged that the drive current deviates from the abovementioned judgment level, it is diagnosed that the switching valve 26 is not switching normally, and control proceeds to step 6 where a fault judgment flag is set, the leakage diagnosis is stopped, and the routine then terminated. That is to say, the function of step 8 corresponds to the second leakage diagnosis stopping device.

In step 8, when judged that the drive current satisfies the abovementioned judgment level, control proceeds to step 9 to execute the leakage diagnosis.

More specifically, the condition with the purge control valve 23 closed, the other port of the switching valve 26 closed and the one port opened, and the electric pump 28 being driven is maintained for a predetermined time, while waiting for an equilibrium condition with the interior of the piping to be leak diagnosed filled by the pressurised air from the electric pump 28.

After lapse of a predetermined time under the equilibrium condition, control proceeds to step 10 where the drive current of the electric pump 28 is detected and stored as a leak test value IPUMPLT. Fuel vapor leakage diagnosis is then performed by comparing the leak test value IPUMPLT with a judgment level DLSL. Here, the judgment level DLSL is set based on the drive current IPUMP of the electric pump 28 for when air is pumped to the reference orifice 24, which is detected in step 4 and stored. However for simplicity the drive current IPUMP may be used as is for the judgment level DLSL.

Then, in step 10, when judged that the leak test value IPUMPLT is greater than the judgment level DLSL, control proceeds to step 11 to diagnose that there are no leaks, while when judged that the drive current is less than or equal to the judgment level, control proceeds to step 12 to diagnose the occurrence of a leak.

More specifically, in the case where the drive current of the electric pump 28 at the time of leakage diagnosis testing is less than the drive current of the electric pump required to pass the air through the reference orifice 24 having the reference aperture diameter, that is to say in the case where the drive load of the electric pump 28 is reduced, it is diagnosed that a crack has occurred equivalent to the opening up of a hole larger than the reference aperture diameter in the fuel vapor introduction passage 20, or the purge passage 22, producing a leak greater than a set level, while in other cases, it is diagnosed that there is no leak (normal).

In this way, in the case where the drive current for when air is pumped to the reference orifice 24 deviates from the reference level due for example to the occurrence of a blockage or contamination in the reference orifice 24, then leakage diagnosis is stopped. Hence erroneous diagnosis using a judgment level set based on a drive current deviating from the reference level can be prevented.

Here, in the case where blockage or contamination occurs in the reference orifice 24, the drive load of the electric pump 28 increases to deviate to the side higher than the upper limit value of the reference level. However, with the present embodiment, since the lower limit value of the reference level is also set, then a fault can be diagnosed and the leakage diagnosis can be stopped when due to a fault in the electric pump 28 or the electric current measuring system or the like, the drive current deviates to the side higher than the upper limit value of the reference level, and also when this deviates to the side lower than the lower limit value of the judgment level.

Next is a description of a second embodiment. With the first embodiment, the lower limit value of the reference level IPUMPSL (=reference value IBASE−ΔI) and the upper limit value (=reference value IBASE+ΔI) are set as constants computed beforehand based on various fluctuations. However with the second embodiment, the reference level is set by correcting the values set based on the various fluctuations, corresponding to air density.

That is to say, in the case such as where the air density drops during high altitude travelling, then the drive current of the electric pump changes. Therefore, with the second embodiment, the air density is detected or estimated, and the reference level then corrected corresponding to the air density. More specifically, for example as shown by the broken lines in FIG. 2, an outside air temperature sensor 35 and an atmospheric pressure sensor 36 are provided, and a correction value KTEMP corresponding to the air density obtained from the outside air temperature and the atmospheric pressure is set in a map. Then using the correction value KTEMP looked up from the map, a lower limit value (=reference value IBASE−ΔI+correction value KTEMP) and an upper limit value (=reference value IBASE+ΔI+correction value KTEMP) of the reference level IPUMPSL is then set. Alternatively, the intake air flow quantity under predetermined conditions, for example idle conditions at the time of low altitude travelling can be made a reference value (set beforehand as a constant), and the intake air flow quantity under the same operating conditions then compared with the reference value to estimate the air density, and thus obtain the correction value KTEMP.

In this way, by correctingly setting the reference level corresponding to the air density, then even in the case where the air density drops at the time of high altitude travelling, it is possible to correctly judge whether or not to stop leakage diagnosis, without being influenced by the air density.

Figure 8:
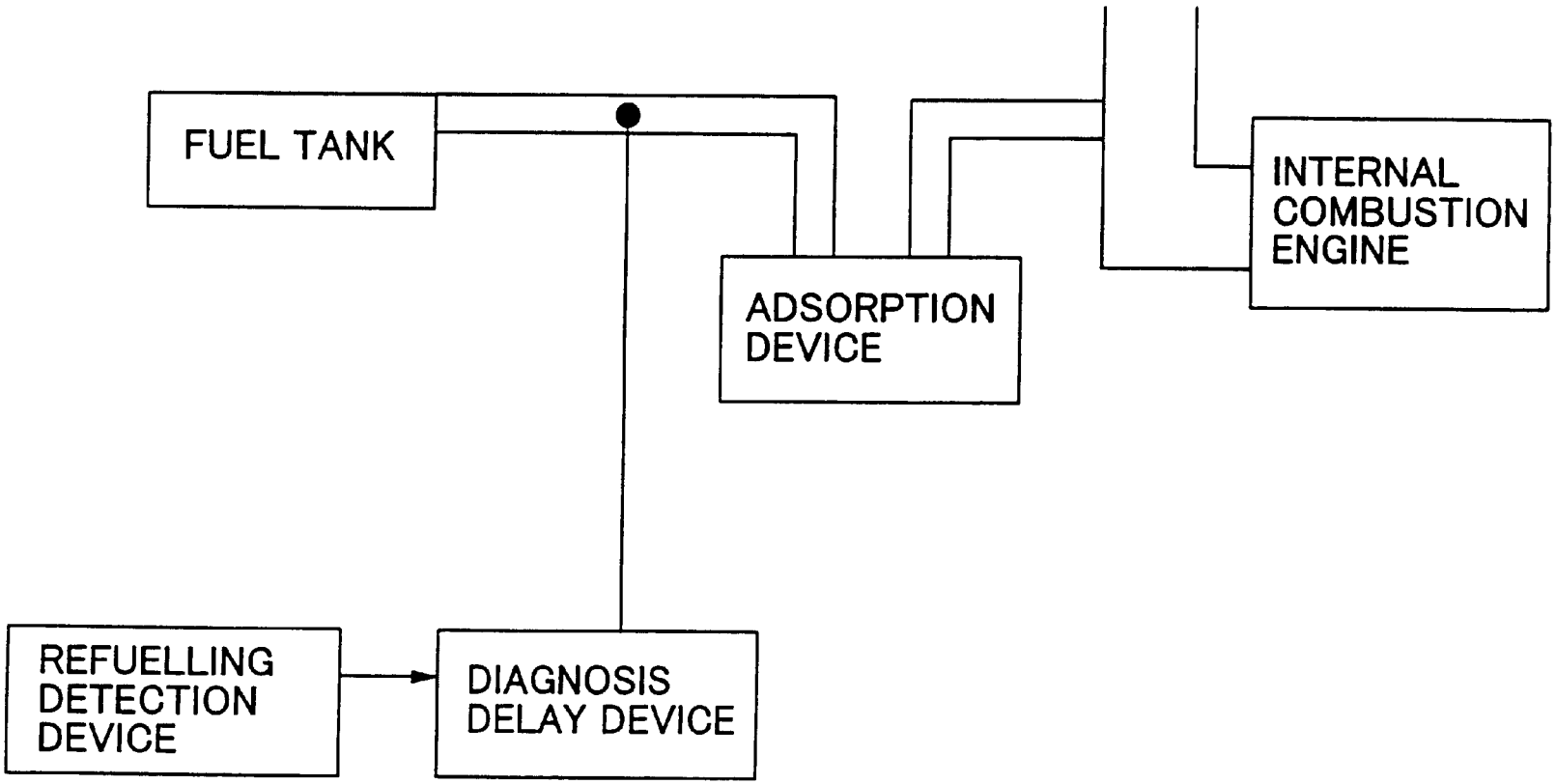
FIG. 8 is a block diagram showing the construction and operation of an embodiment according to the second aspect of the invention.

Next is a description of an embodiment according to a second aspect of the invention. In FIG. 8 showing the construction and operation of an embodiment according to the second aspect of the invention, an adsorption device temporarily adsorbs fuel vapor from a fuel tank of an internal combustion engine, and the adsorbed fuel vapor is then drawn into an engine intake system under predetermined engine operating conditions.

A refuelling detection device detects whether or not the fuel tank is being refuelled after engine operation has stopped.

A diagnosis delay device starts diagnosis for the presence of fuel vapor leakage by the leakage diagnosis device, after completion of the refuelling.

With the system structure of the embodiment according to the second aspect of the invention, the parts shown by the full lines in FIG. 1 illustrating the system structure of the first embodiment are common thereto and hence description is omitted.

With this construction, a fuel vapor leakage diagnosis routine performed by the control unit 6, according to a first embodiment according to the second aspect of the invention will be explained with reference to the flow chart of FIG. 9.

In step 21, it is judged if predetermined leakage diagnosis start conditions, for example the following conditions, have been met.

Engine rotational speed and vehicle speed are each below predetermined values, or the engine is stopped.

It is diagnosed in a separately executed fault diagnosis routine for the purge control valve 23 that there are no faults.

Figure 10:
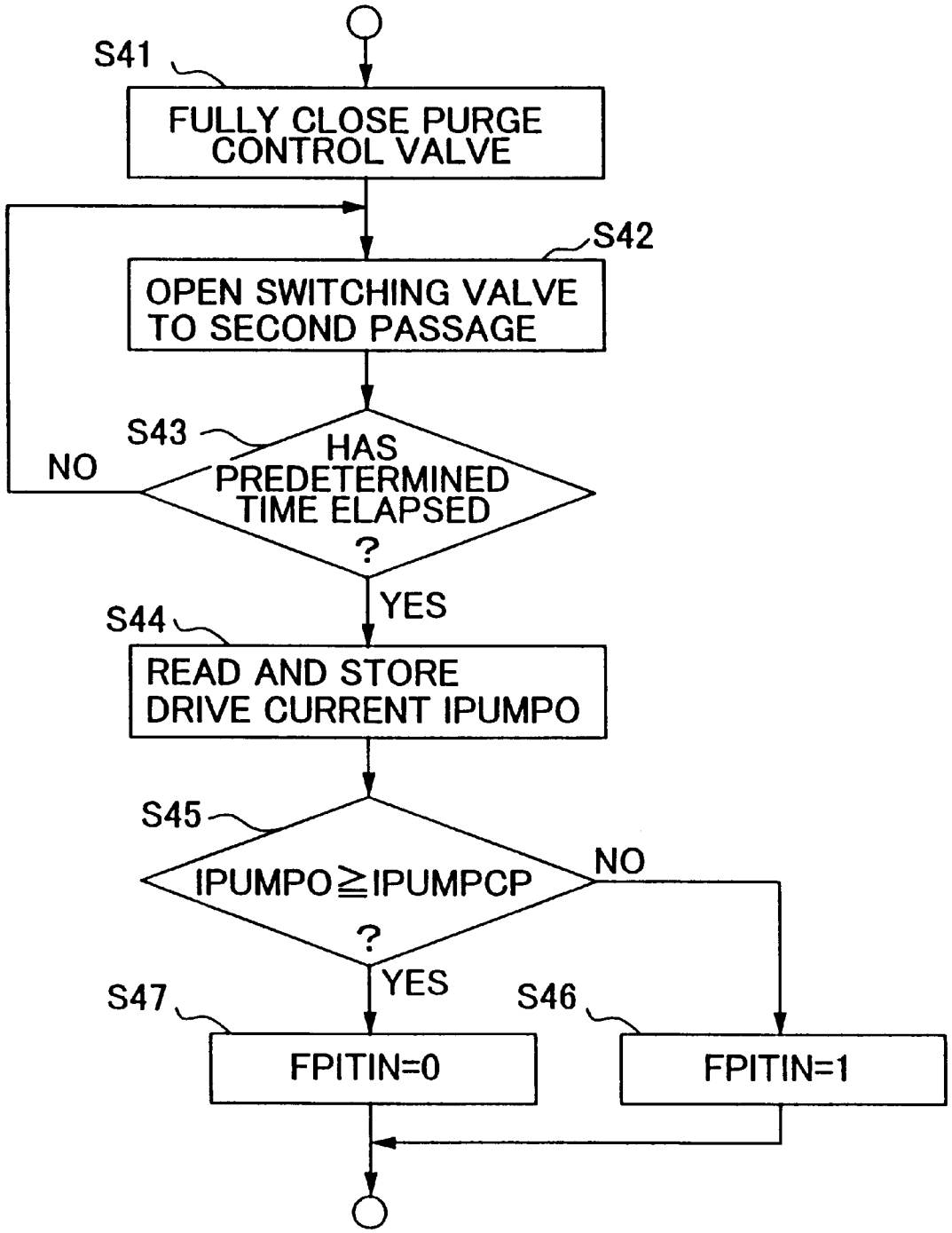
FIG. 10 is a flow chart showing a subroutine of the leakage diagnosis routine of FIG. 9.

When judged in step 21 that the leakage diagnosis conditions have materialized, control proceeds to step 22 to execute refuelling judgment. The subroutine for the refuelling judgment will be described with reference to the flow chart of FIG. 10. The purge control valve 23 is fully closed (step 41), the switching valve 26 is opened to the second passage 27 (step 42), a drive current IPUMPO of the electric pump 28 is measured after elapse of a predetermined time and stored (step 43, 44), and the drive current IPUMPO is compared with a threshold value IPUMPCP for discriminating a condition where the filler cap is opened (step 45). When less than the threshold value it is judged that refuelling is being carried out, and a flag FPITN is set to 1 (step 46). When greater than or equal to the threshold value, it is judged that there is no refuelling, and the flag FPITN is set to zero (step 47). That is to say, at the time of no refuelling, when the respective valves are closed and the electric pump 28 is driven to pump the air to inside of the sealed fuel vapor supply system, the pressure inside the system rises, and hence the drive current increases. On the other hand, when the filler cap is opened for refuelling, the pressure inside the system does not increase even though the air is being pumped, and hence the drive current remains small. Therefore by comparing the drive current with the threshold value it can be accurately judged whether or not there is refuelling. Now, at the time of leakage, the pressure inside the system reduces. However compared to the pressure under the condition with the filler cap released during refuelling, there will be a sufficiently high increase in pressure to avoid an erroneous judgment. Moreover, the predetermined time is set to $+\alpha$, the time required for the pressure inside the system to balance after starting the electric pump 28 (a time determined by the system capacity and the pump discharge rate).

Figure 9:
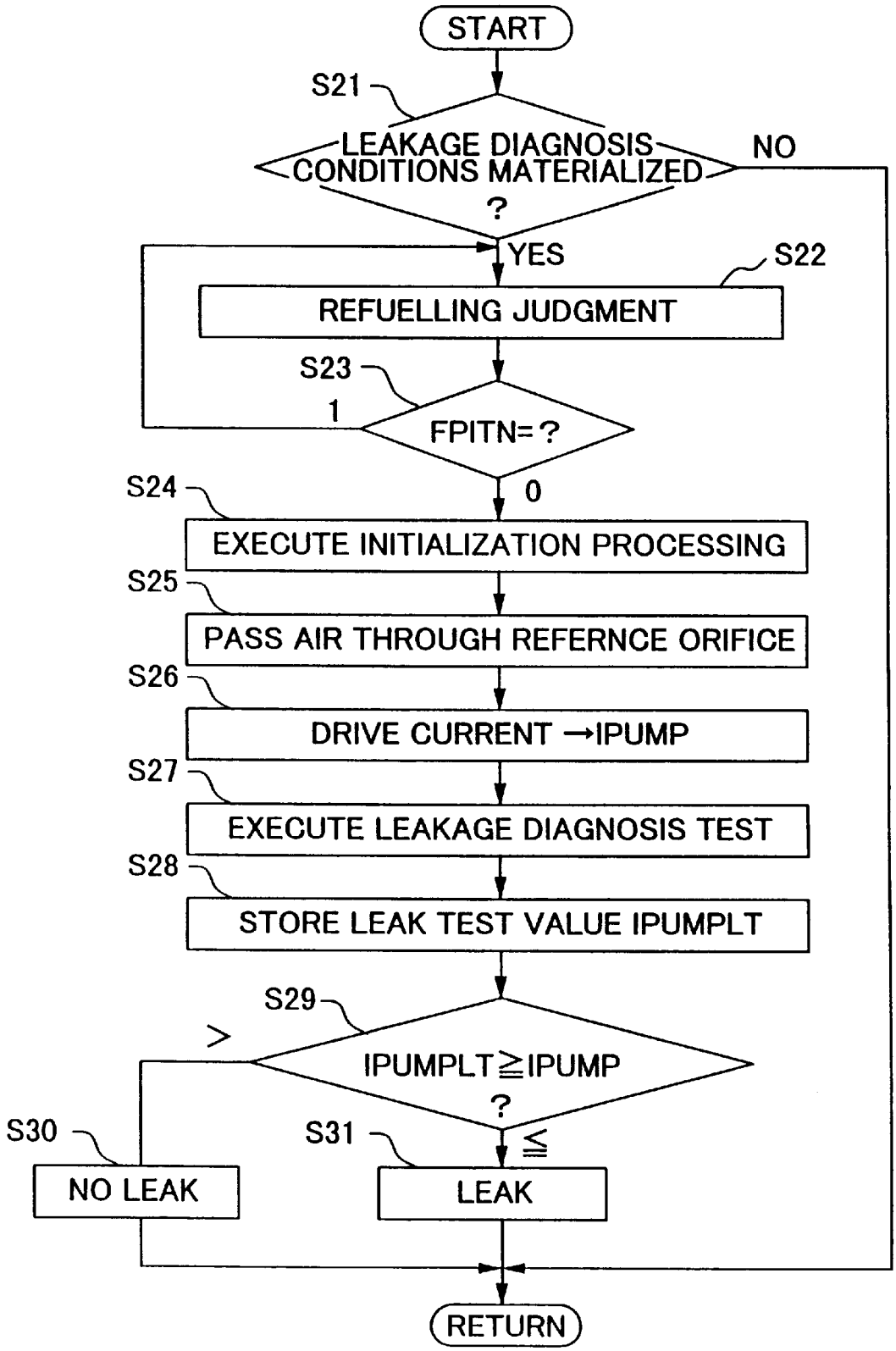
FIG. 9 is a flow chart showing a leakage diagnosis routine of a first embodiment according to the second aspect of the invention.

After carrying out this refuelling judgment, control proceeds to step 23 of FIG. 9 where the value of the flag FPITN is judged.

When judged that the value of the flag FPITN is "1", that is, refuelling is being performed, control returns to step 22 and refuelling judgment is continued, while when judged that the value of flag FPITN is "0", that is refuelling has been completed or, from the start, refuelling has not been carried out, control proceeds to step 24 to effect leakage diagnosis.

At first, in step 24, processing for initializing the fuel vapor purge system environment is executed. More specifically, the purge control valve 23 is opened, the one port of the switching valve 26 is closed, the other port is opened, and the electric pump 28 is driven, and this condition is maintained for a predetermined time.

Figure 11:
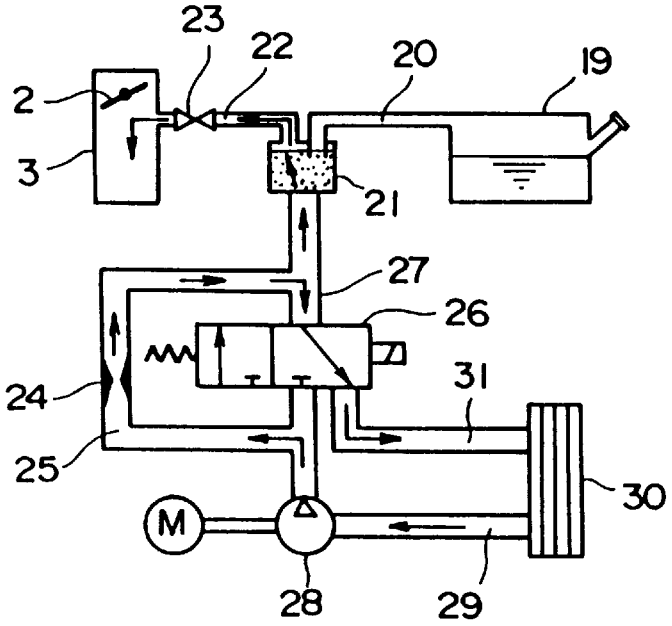
FIG. 11 is a diagram showing the flow of air at the time of executing initialization processing in the first embodiment according to the second aspect of the invention.

At this time, as shown in FIG. 11, due to operation of the electric pump 28, air introduced via the air filter 30 and the air introduction passage 29 passes via the first passage 25 through the canister 21 and is discharged into the intake passage 3 via the purge passage 22. Furthermore, a part of the air passes from the switching valve 26 via the air discharge passage 31 and the air filter 30 and is discharged into the atmosphere.

As a result, the residual pressure (negative pressure) and residual gas inside the purge passage 22 is eliminated.

Then, prior to executing leakage diagnosis, the leakage diagnosis system performs self diagnosis. At first, in step 25, the purge control valve 23 is closed, the one port of the switching valve 26 is closed, the other port is opened, and the electric pump 28 is driven, and this condition is maintained for a predetermined time.

Figure 12:
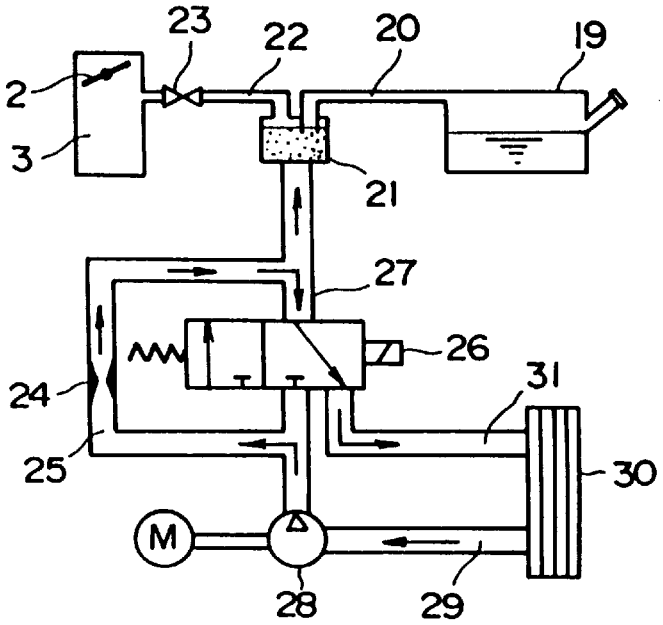
FIG. 12 is a diagram showing the flow of air at the time of setting a judgment level in the first embodiment according to the second aspect of the invention.

At this time, as shown in FIG. 12, due to operation of the electric pump 28, air introduced via the air filter 30 and the air introduction passage 29, passes via the first passage 25 and is discharged into the atmosphere from the switching valve 26 via the air discharge passage 31 and the air filter 30.

After lapse of a predetermined time under this condition, control proceeds to step 26 where the drive current of the electric pump 28 is detected and stored as a reference value IPUMP. That is to say, the drive current of the electric pump 28 for when the air passes through the reference orifice 24 having the reference aperture diameter is detected as a reference value for leakage diagnosis judgment, to be discussed hereunder.

In step 27, a leakage diagnosis test is executed. More specifically, the purge control valve 23 is closed, the one port of the switching valve 26 is opened, the other port is closed, and the electric pump 28 is driven, and this condition is maintained for a predetermined time.

Figure 13:
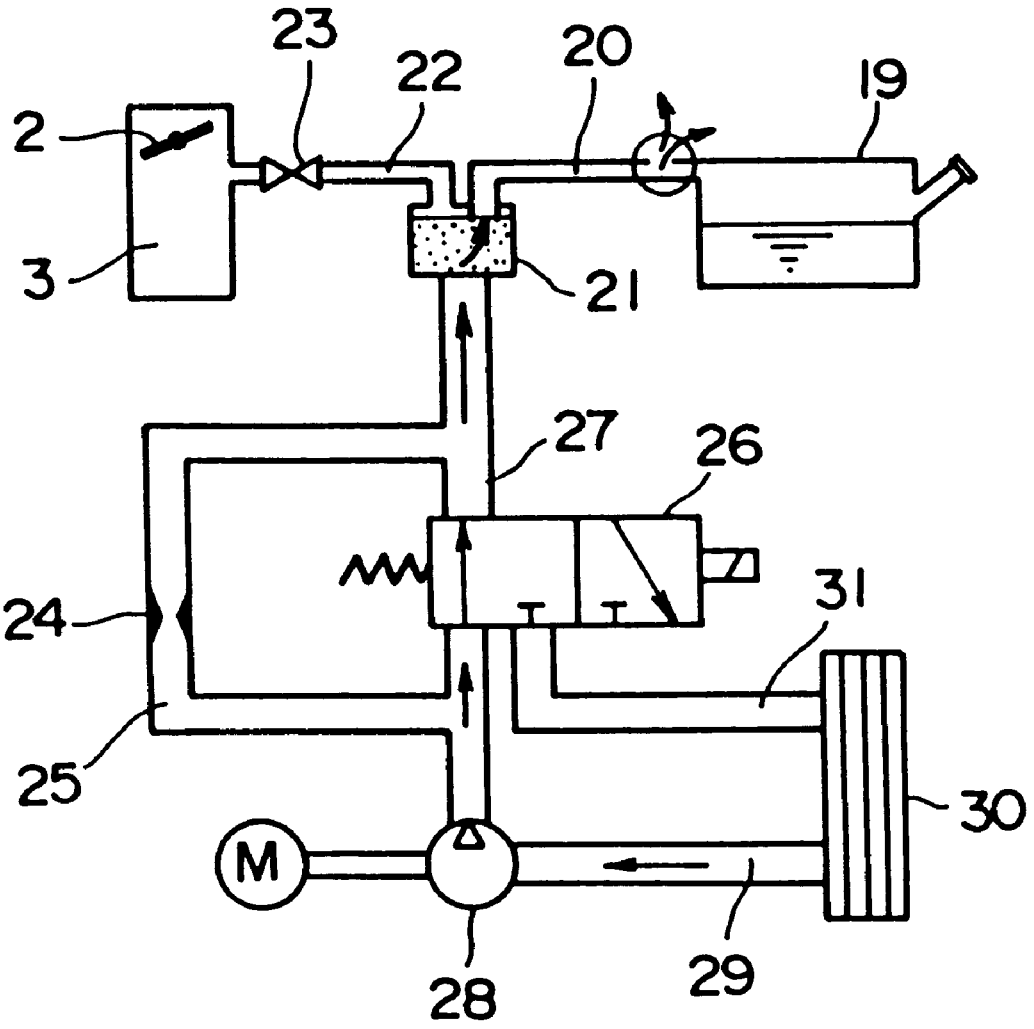
FIG. 13 is a diagram showing the flow of air at the time of executing leakage diagnosis testing in the first embodiment according to the second aspect of the invention.

At this time, as shown in FIG. 13 the air introduced via the air filter 30 and the air introduction passage 29 due to operation of the electric pump 28, passes via the second passage 27 through the canister 21 and flows into the fuel vapor introduction passage 20 and the purge passage 22, reaching from the fuel tank 19 to the purge control valve 23.

After elapse of a predetermined time under this condition, control proceeds to step 28 where the drive current of the electric pump 28 is detected and stored as a leak test value IPUMPLT.

In step 29, the leak test value IPUMPLT detected in step 28 is compared with the reference value IPUMP stored in step 26.

Then in step 29, when judged that the leak test value IPUMPLT is greater than the reference value IPUMP, control proceeds to step 30 to diagnose that there are no leaks, while when judged that the drive current is less than or equal to the judgment level, control proceeds to step 31 to diagnose the occurrence of a leak.

More specifically, in the case where the drive current of the electric pump 28 at the time of leakage diagnosis testing is less than the drive current of the electric pump required to pass the air through the reference orifice 24 having the reference aperture diameter, that is to say in the case where the drive load of the electric pump 28 is reduced, it is diagnosed that a crack has occurred equivalent to the opening up of a hole larger than the reference aperture diameter in the fuel vapor introduction passage 20, or the purge passage 22, producing a leak greater than a set level, while in other cases, it is diagnosed that there is no leak (normal).

In this way, in the case where refuelling is performed after stopping engine operation, since leakage diagnosis is not performed until after completion of refuelling, erroneous diagnosis is prevented. Hence leakage diagnosis can be executed with a high accuracy for each resumption of travel.

Next is a description of a second embodiment according to the second aspect of the invention. With the first embodiment, after stopping the engine, refuelling detection was continued until completion of refuelling, and after detecting completion, leakage diagnosis was started. With the second embodiment however, if once detecting that refuelling is being performed after stopping the engine, leakage diagnosis is started after waiting for the lapse of a predetermined time thereafter sufficient for completion of refuelling.

Figure 14:
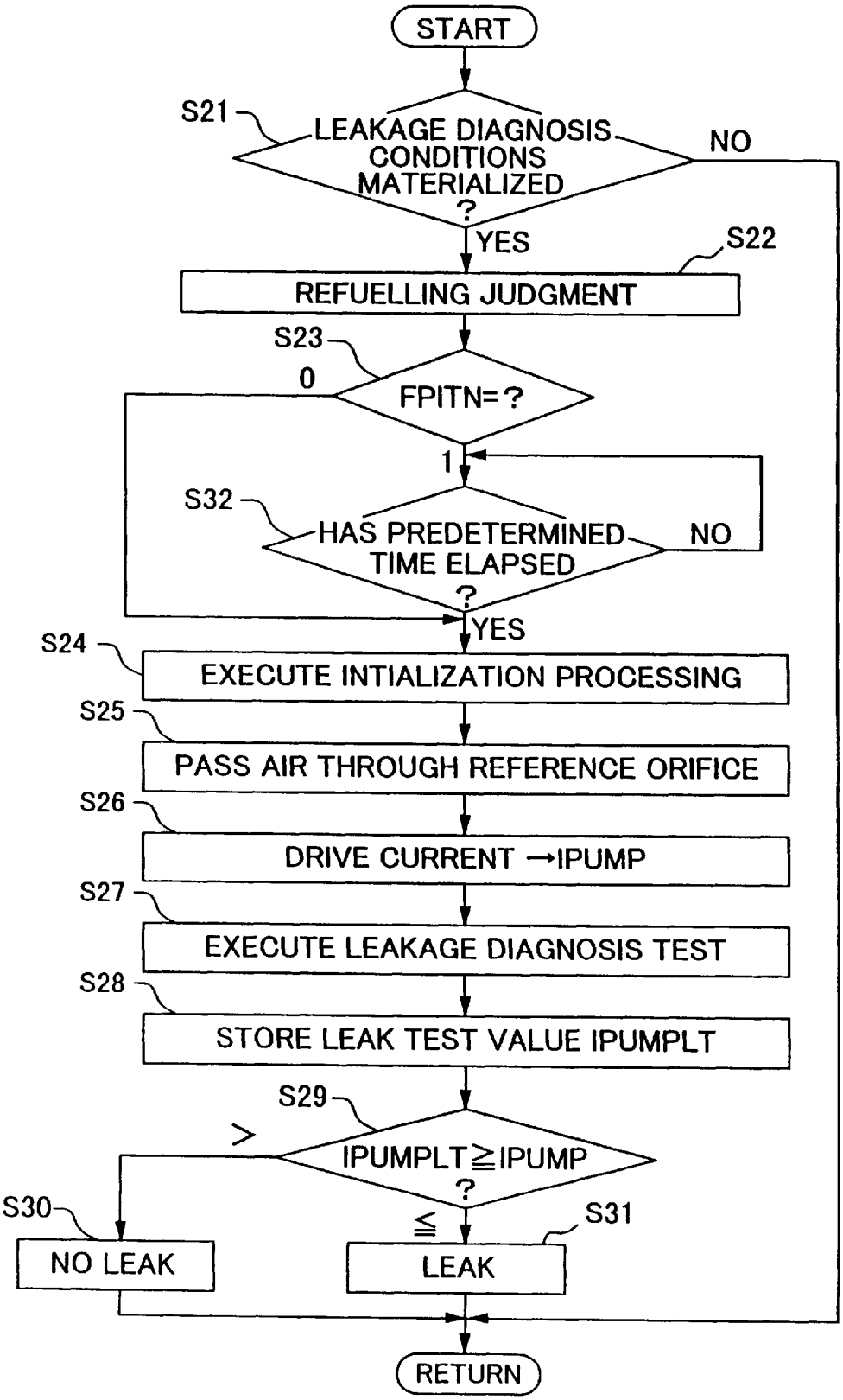
FIG. 14 is a flow chart showing a leakage diagnosis routine of a second embodiment according to the second aspect of the invention.

FIG. 14 shows a fuel vapor leakage diagnosis routine according to the second embodiment. The point different from FIG. 9 is that in step 23, after judging that the value of the flag FPITN for judging refuelling is "1", that is refuelling is being performed, then in step 32 there is a wait until the lapse of the predetermined time, before control proceeds to step 24 to effect leakage diagnosis.

In this way, the fact that there is refuelling need only be detected once, and hence detection load is reduced.

What is claimed is:

1. A method of diagnosing leakage of a fuel vapor treatment unit which temporarily adsorbs fuel vapor from a fuel tank of an internal combustion engine into an adsorption means and then draws this into an engine intake system under predetermined engine operating conditions, said method comprising the steps of;

setting a judgment level based on a drive current of an electric pump for when air is pumped by said electric pump via a reference orifice having a reference aperture diameter, and diagnosing the presence of fuel vapor leakage by comparing a drive current of said electric pump for when air is pumped by said electric pump bypassing said reference orifice and into piping to be leak diagnosed of said fuel vapor treatment unit, with said set judgment level, and further comprising the step of;

comparing the drive current of said electric pump for when air is pumped via said reference orifice, with a reference level, and when the drive current deviates from the reference level, stopping said leakage diagnosis.

2. A method of diagnosing leakage of a fuel vapor treatment unit according to claim 1, wherein said reference level is set based on various fluctuations.

3. A method of diagnosing leakage of a fuel vapor treatment unit according to claim 1, wherein said reference level is correctingly set corresponding to air density.

4. A method of diagnosing leakage of a fuel vapor treatment unit according to claim 1, wherein said fuel vapor treatment unit incorporates a switching valve for switching between a passage which passes air from said electric pump via the reference orifice, and a passage bypassing the reference orifice, which passes air via piping to be leak diagnosed, and said leakage diagnosis is also stopped when the drive current of the electric pump immediately after switching said switching valve from the passage via the reference orifice to the passage bypassing the reference orifice, deviates from a judgment level set corresponding to immediately after said switching.

5. A leakage diagnosis apparatus for a fuel vapor treatment unit, said apparatus comprising a fuel vapor treatment unit which temporarily adsorbs fuel vapor from a fuel tank of an internal combustion engine into an adsorption means and then draws this into an engine intake system under predetermined engine operating conditions, and also comprising;

judgment level setting means for setting a judgment level based on a drive current of an electric pump for when air is pumped by said electric pump via a reference orifice having a reference aperture diameter, and leakage diagnosis means for diagnosing the presence of fuel vapor leakage by comparing a drive current of said electric pump for when air is pumped by said electric pump bypassing the reference orifice and into piping to be leak diagnosed of said fuel vapor treatment unit, with said set judgment level, and further comprising;

leakage diagnosis stopping means for comparing the drive current of said electric pump for when air is pumped via said reference orifice, with a reference level, and when the drive current deviates from the reference level, stopping diagnosis by said leakage diagnosis means.

6. A leakage diagnosis apparatus for a fuel vapor treatment unit according to claim 5, wherein said reference level is set based on various fluctuations.

7. A leakage diagnosis apparatus for a fuel vapor treatment unit according to claim 5, wherein said reference level is correctingly set corresponding to air density.

8. A leakage diagnosis apparatus for a fuel vapor treatment unit according to claim 7 incorporating a switching valve for switching between a passage which passes air from said electric pump via the reference orifice, and a passage bypassing the reference orifice, which passes air via piping to be leak diagnosed, and comprising second leakage diagnosis stopping means for stopping leakage diagnosis by said leakage diagnosis means when the drive current of the electric pump immediately after switching said switching valve from the passage via the reference orifice to the passage bypassing the reference orifice, deviates from a judgment level set corresponding to immediately after said switching.

* * * * *